United States Patent [19]

Kauffman et al.

[11] 4,221,162

[45] Sep. 9, 1980

[54] CARTON BOTTOM TUCKING AND TACKING APPARATUS FOR PACKAGING MACHINES

[75] Inventors: Ivan L. Kauffman, Commerce Township, Oakland County; Robert J. Allen, Farmington, both of Mich.

[73] Assignee: Ex-Cell-O Corporation, Troy, Mich.

[21] Appl. No.: 4,932

[22] Filed: Jan. 19, 1979

[51] Int. Cl.[3] ..... B31B 1/32

[52] U.S. Cl. ..... 93/36.8; 93/44.1 R

[58] Field of Search ..... 93/36.8, 44.1 R, 44.1 GT, 93/44, 49 R; 53/375, 374

[56] References Cited

U.S. PATENT DOCUMENTS

| | | | |
|---|---|---|---|
| 3,212,413 | 10/1965 | Allen et al. | 93/44.1 GT |
| 3,248,841 | 5/1966 | Heffelfinger et al. | 93/44.1 GT |
| 3,350,837 | 11/1967 | Hagerborg | 93/44.1 GT |
| 3,593,625 | 7/1971 | Garrett | 93/44.1 GT X |
| 3,845,607 | 11/1974 | Farfaglia | 93/44.1 GT |
| 3,943,834 | 3/1976 | Vetten | 93/44.1 R X |

*Primary Examiner*—James F. Coan
*Attorney, Agent, or Firm*—Robert G. Mentag

[57] ABSTRACT

A carton bottom end tucker-tacker assembly for folding over, closing and tacking the bottom ends of a pair of cartons mounted on a pair of mandrels on a packaging machine. The tucker-tacker apparatus includes a tucker means for engaging a pair of opposed triangular bottom end closure members on the bottom ends of a pair of cartons and breaking the bottom end closure members and folding them inwardly toward a closed position, after which the tucker apparatus recedes and a pair of swingably mounted tucker and tacker jaws then move under the partially closed bottom end members of the pair of cartons and complete the folding and tucking operations, and concluding with a tacking in place of the bottom end closure tuck-over panel to retain the bottom end closure members in a square condition for subsequent transferral to a carton bottom end pressure sealing operation. The tucker jaw and the tacker jaw are each water cooled, and they are adapted to be operated by the same power drive means as used to operate the tucker apparatus. In one embodiment the tucker apparatus comprises a vertically disposed plate with a pair of recesses having angled sides for simultaneously engaging the bottom ends of a pair of adjacently disposed cartons for a breaking and partial forming operation on the carbon bottom end closure members. In another embodiment, the last described tucking operation is carried out by two pairs of oscillatable tucker blades which are movable between operative and inoperative positions by the same power drive means that is used in the first embodiment.

11 Claims, 13 Drawing Figures

CARTON BOTTOM TUCKING AND TACKING APPARATUS FOR PACKAGING MACHINES

TECHNICAL FIELD

This invention relates generally to the packaging machine art, and more particularly to a carton bottom tucker-tacker assembly for use with packaging machines. The invention is specifically concerned with a tucker-tacker assembly for simultaneously tucking and tacking the bottoms of two cartons at the same time.

BACKGROUND ART

It is known in the packaging machine art to provide tucking apparatus for folding and tucking the bottoms of cartons, and then moving the carton directly into a sealing station without any intermediate tacking of the folded carton bottoms. A disadvantage of the prior art tucker apparatus is that after the carton bottom ends have been folded and tucked, they must be held in position while they are slid along guide rails to a pressure sealing station in the packaging machine. The last mentioned required sliding movement of the folded carton bottoms causes a backdrag on the carton bottoms which in many instances moves the carton bottom closure members off balance, so that they are not sealed squarely in the subsequent sealing operation. A further disadvantage of the prior art tucker apparatuses is the fact that they are not readily adaptable for use in a packaging machine which may be indexing more than one carton along a carton processing path. Another disadvantage of the prior art carton bottom tucker apparatuses is that they employ many parts, and they are costly and repairs are difficult to make. Examples of the prior art carton bottom tucker apparatuses are disclosed in U.S. Pat. Nos. 3,120,089; 3,166,994; 3,183,801; 3,187,647; 3,212,413; and 3,398,659.

DISCLOSURE OF THE INVENTION

This invention relates to the carton or container packaging art, and to a tucker-tacker assembly for simultaneously performing a carton bottom closing and tacking operation on a pair of cartons in a packaging machine for forming, filling and closing cartons, and wherein said packaging machine is an indexing packaging machine which indexes cartons in pairs through various work stations to accomplish forming, filling and sealing of the cartons.

The tucker-tacker assembly includes a tucker apparatus which is movable from a retracted position to a raised operative position for simultaneously engaging the bottom end closure members of a pair of cartons, and for breaking and partially folding the bottom end closure members toward closed positions. In one embodiment, the tucker apparatus comprises a single, vertically disposed plate with a pair of recesses having converging tapered edges which carry out the breaking and partial folding operations. In another embodiment, the tucking apparatus comprises two pairs of oscillatable tucker blades for simultaneously breaking and partially folding the bottom end closure members of a pair of cartons disposed in side-by-side relationship on a pair of mandrels carried on a packaging machine.

The tucker-tacker assembly includes a swingably mounted tucker jaw which extends over a portion of the bottom ends of a pair of cartons, and it is adapted to move a bottom end closure tuck-in panel to a tucked-in position. The tucker-tacker assembly also includes a swingably mounted tacker jaw which extends under another portion of said pair of cartons, and it is adapted to be swung from an inoperative position to an operative position whereby the tuck-over panels of the bottom end closure members of the cartons are each moved into a closed position and tacked in place to form a square bottom end. The tucker apparatus, and the tucking jaw and the tacking jaw are all operated by a power drive means which is driven by the main drive shaft of the packaging machine with which the tucker-tucker assembly is associated.

BEST MODE OF CARRYING OUT THE INVENTION

Figure 1:
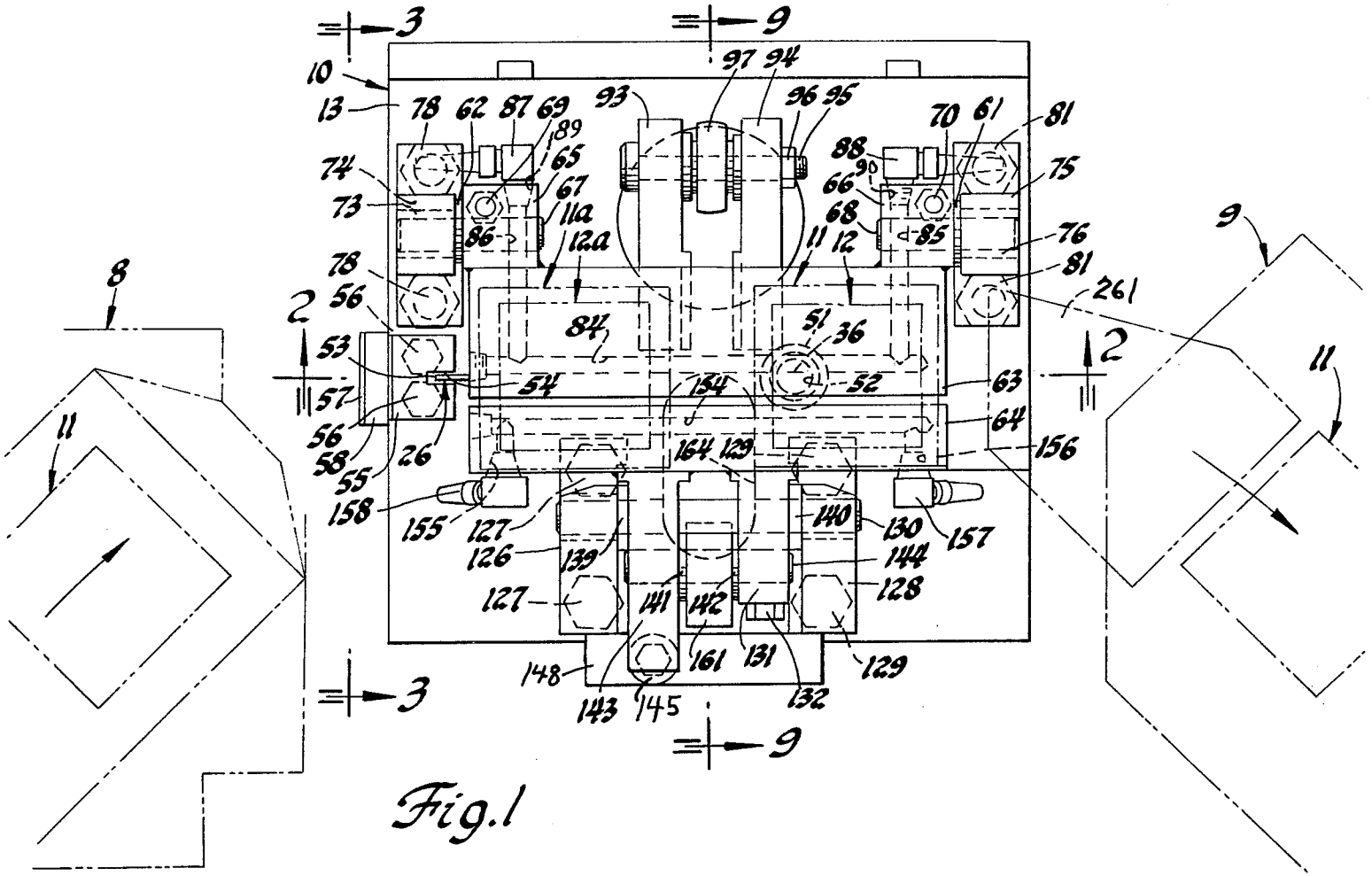
FIG. 1 is a top plan view of a carton bottom tucker-tacker assembly made in accordance with the principles of the present invention.

Referring now to the drawings, and in particular to FIG. 1, the numeral 8 designates a carton bottom heater station on a conventional rotary turret which is rotatable clockwise, as viewed in FIG. 1. The rotary turret is of the type which carries two mandrels at each station, and which indexes two mandrels from one work station to the next work station. The numeral 10 generally indicates the carton bottom tucker-tacker assembly of the present invention which is disposed at a tucker-tacker station. The numeral 9 generally indicates a carton bottom pressure station, at which station the carton bottoms are sealed by a conventional sealing apparatus.

The numeral 11 and 11*a* in FIG. 1 designate a pair of quart size cartons which may be tucked and tacked by the apparatus 10 of the present invention, and the numerals 12 and 12*a* designate a pair of smaller cross section cartons which may be tucked and tacked by the apparatus of the present invention.

Figure 3:
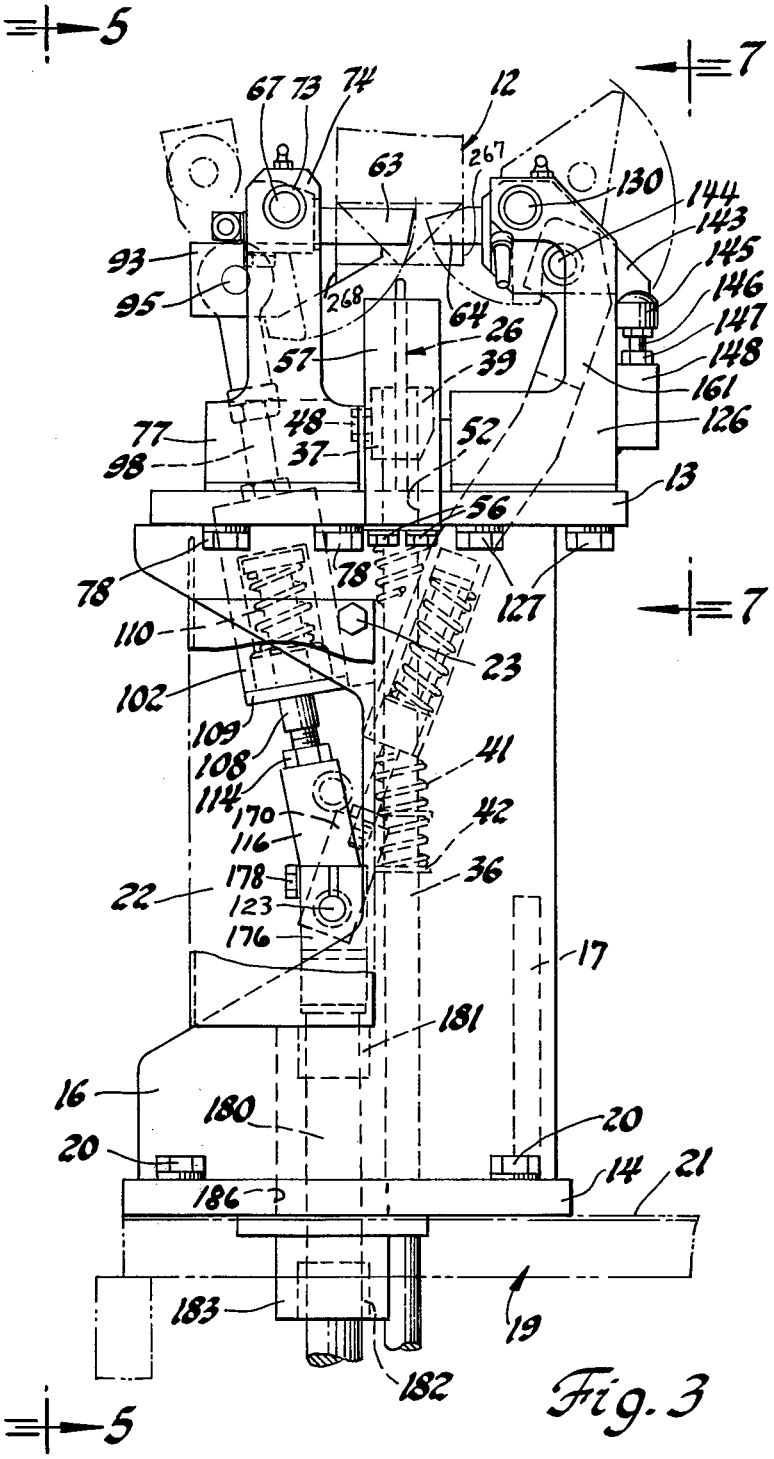
FIGS. 3 and 3A comprise a left side elevation view of the tucker-tacker structure illustrated in FIG. 1, taken along the line 3—3 thereof, and looking in the direction of the arrows.
Figure 4:
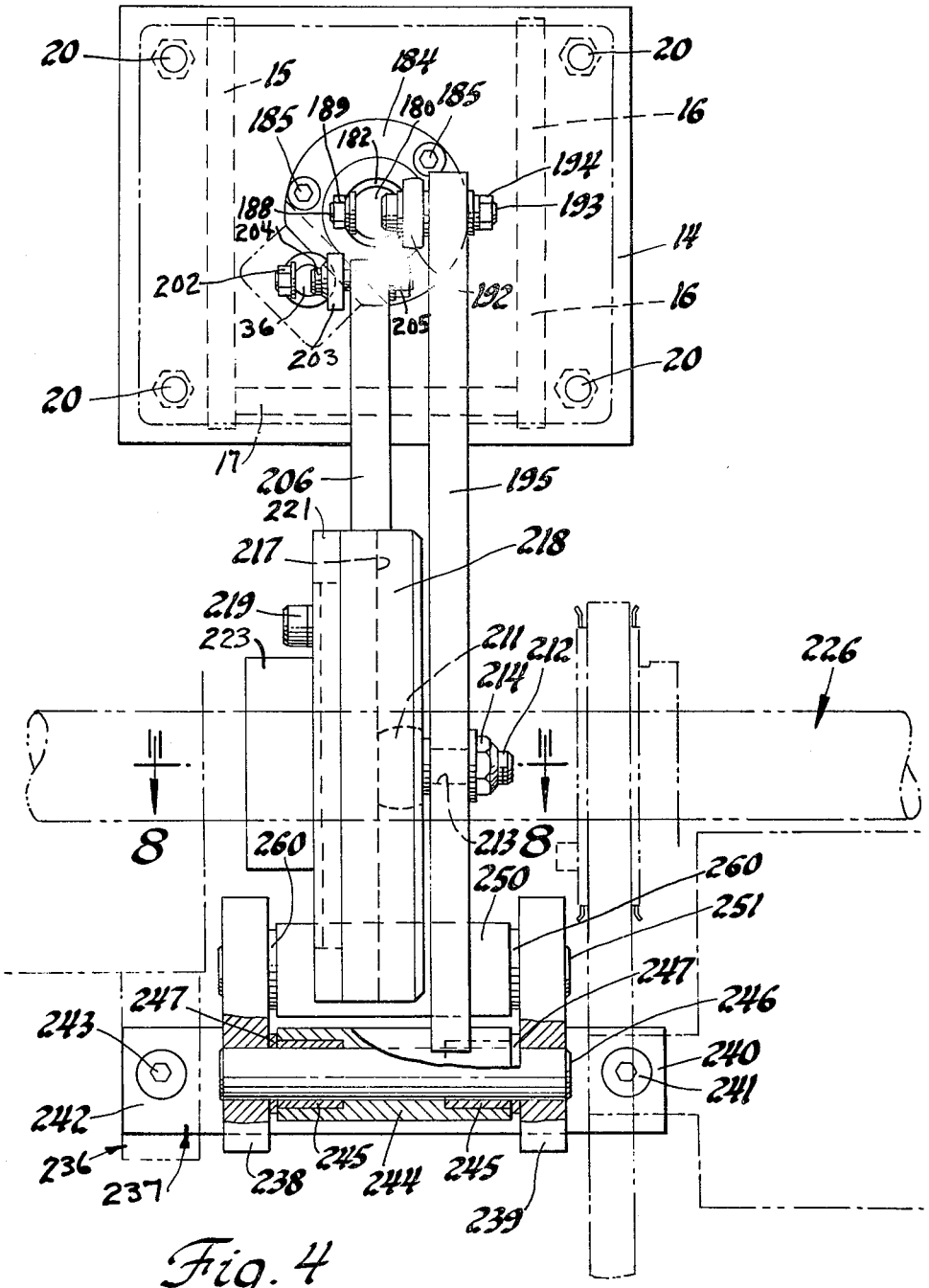
FIG. 4 is a bottom plan view of the tucker-tacker structure illustrated in FIG. 3A, taken along the line 4—4 thereof, and looking in the direction of the arrows.
Figure 5:
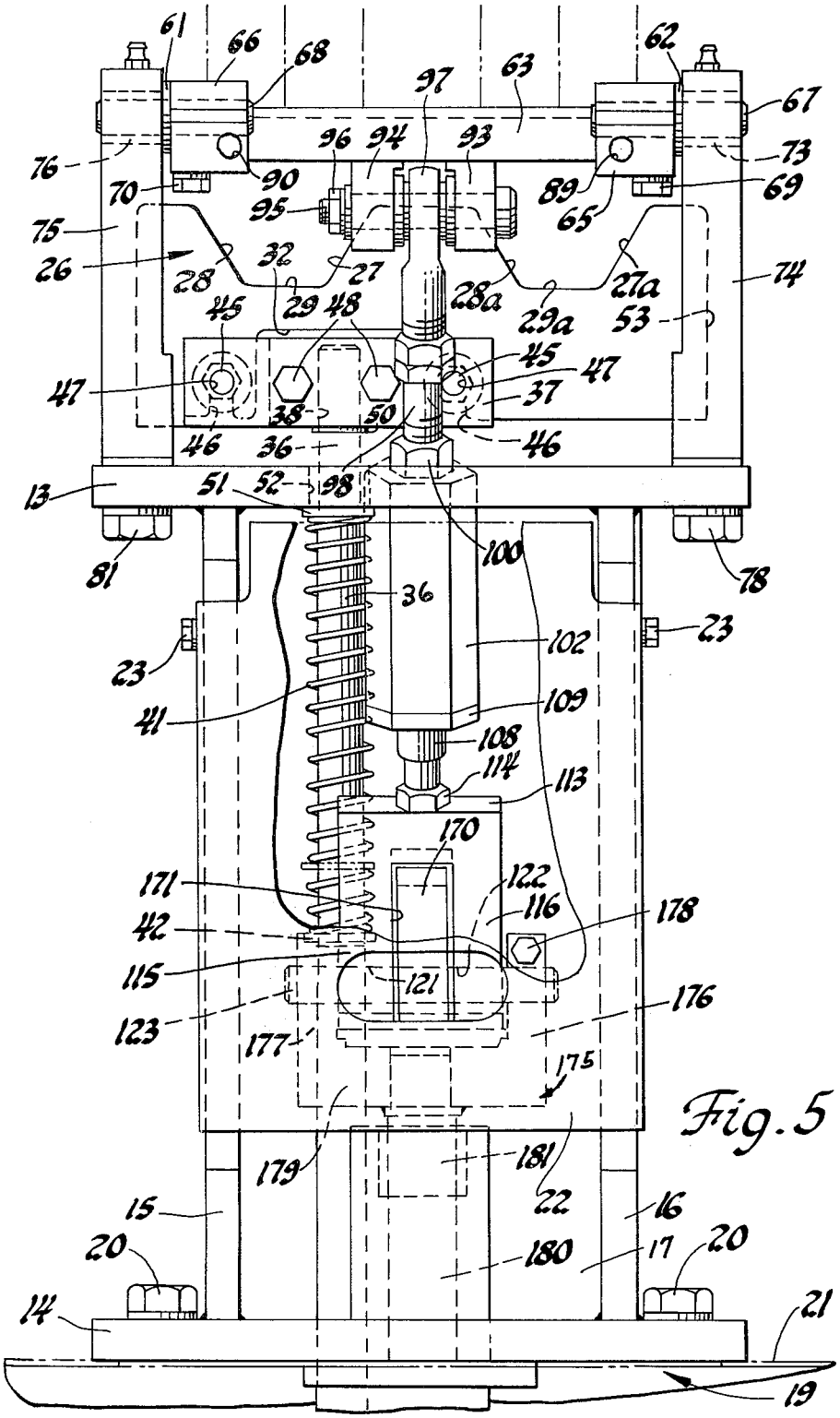
FIG. 5 is a left side elevation view of the tucker-tacker structure illustrated in FIG. 3, taken along the line 5—5 thereof, and looking in the direction of the arrows.

As best seen in FIG. 5, the tucker-tacker assembly 10 includes an upper horizontal mounting plate 13 and a lower horizontal mounting plate 14 which are joined by a pair of laterally spaced apart vertical frame plates 15 and 16. The frame plates 15 and 16 are fixedly secured to the vertically spaced apart mounting plates 13 and 14 by any suitable means, as by welding. As shown in FIGS. 3 and 4, a support plate 17 is fixedly secured between the vertical frame plates 15 and 16 by any suitable means, as by welding. As shown in FIGS. 3 and 5, the lower mounting plate 14 is seated on the machine base plate 19 of the packaging machine with which the tucker-tacker assembly 10 is associated, and it is secured thereto by suitable machine screws 20. The numeral 21 in FIGS. 3 and 5 indicates the usual stainless steel skin or cover plate which is mounted over the packaging machine base plate 19. The numeral 22 in FIGS. 3 and 5 designates a cover plate which has a flange on each side that is secured to the outer sides of the vertical frame plates 15 and 16 by suitable machine screws 23.

Figure 2:
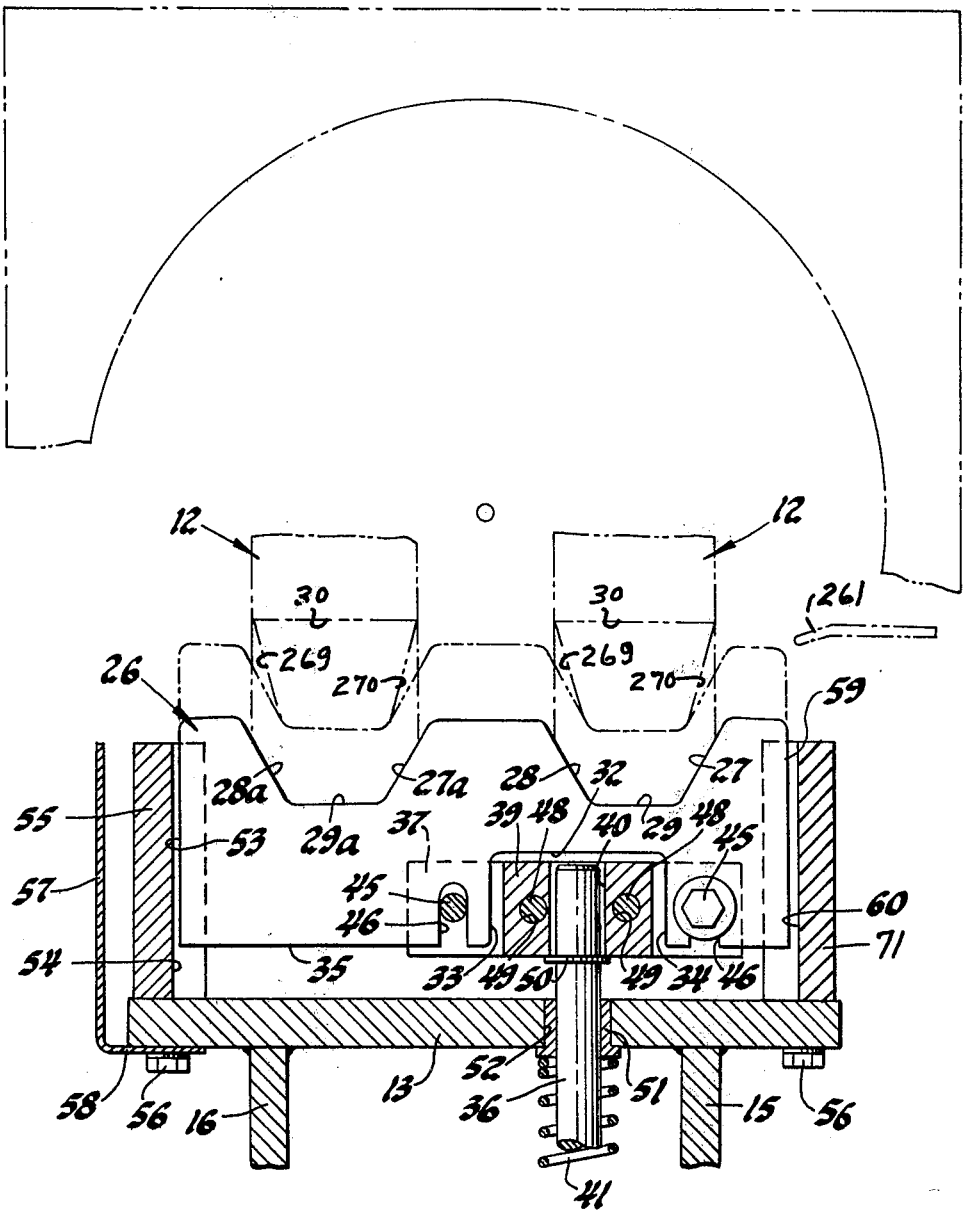
FIG. 2 is a fragmentary, elevational section view, with parts removed, of the tucker-tacker structure illustrated in FIG. 1, taken along the line 2—2 thereof, and looking in the direction of the arrows.
Figure 9:
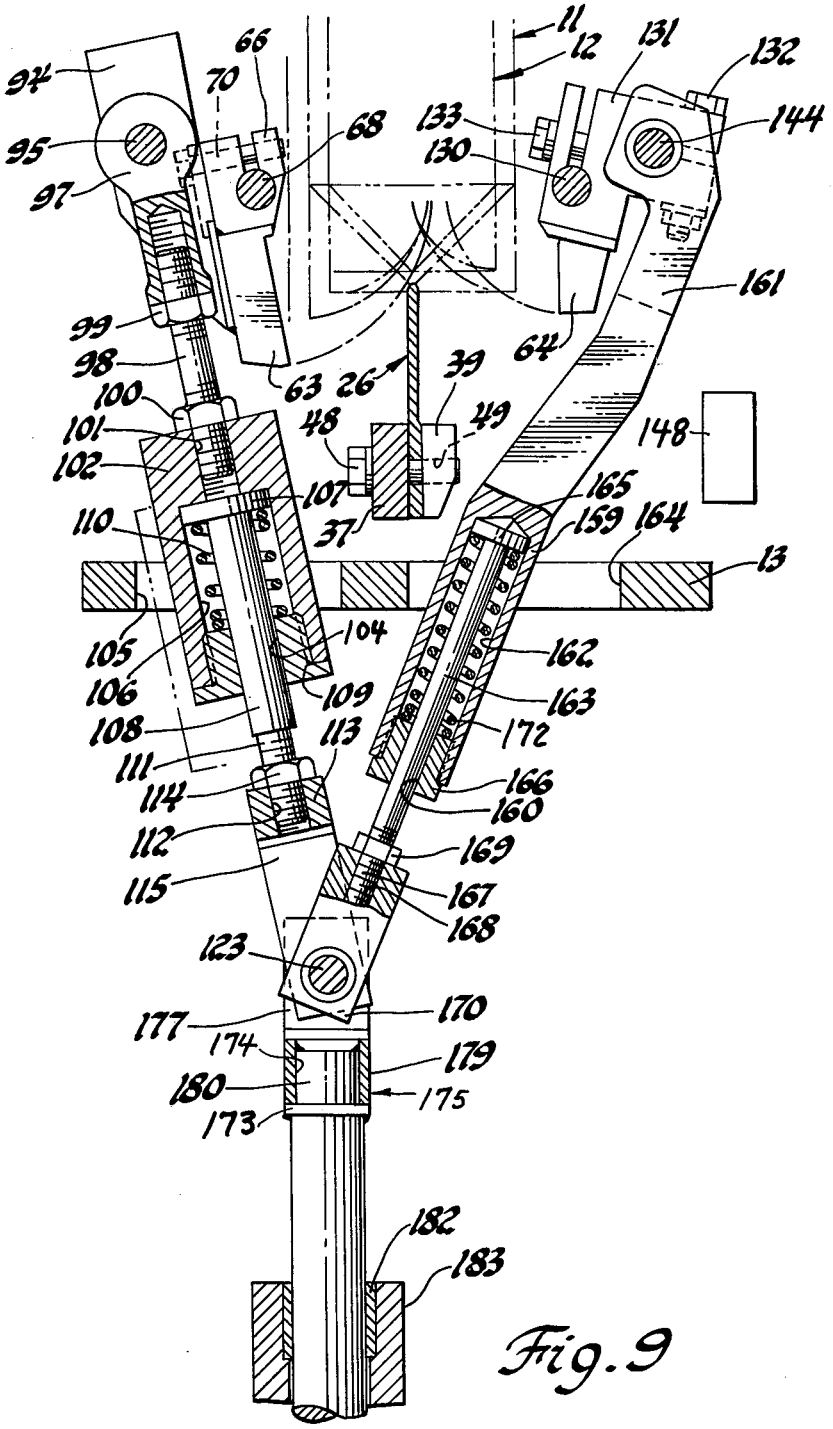
FIG. 9 is a fragmentary, elevation section view of the tucker-tacker structure illustrated in FIG. 1, taken along the line 9—9 thereof, and looking in the direction of the arrows.

As shown in FIGS. 2 and 5, the tucker-tacker assembly 10, includes a vertically disposed tucker blade, generally indicated by the numeral 26, which is adapted to break and fold the bottom ends of the two cartons simultaneously. As shown in FIGS. 1, 2 and 9, the tucker blade 26 is disposed along the line of travel of the cartons 12. As best seen in FIGS. 2 and 5, the tucker blade 26 is provided with two longitudinally spaced apart recesses. One is bounded by two tapered converging edges 27 and 28 which terminate at their inner ends at the horizontal plate edge 29. The other recess is bounded by similar tapered edges 27*a* and 28*a* and the inner edge 29*a*.

As illustrated in FIG. 2 when the tucker plate 26 is moved upwardly to the broken line position, by operating apparatus described hereinafter, the tapered edges 27 and 28, and 27*a* and 28*a* engage the usual triangular panels of the carton bottom closure members on the pair of cartons 12 and move them inwardly to carry out the usual carton bottom breaking and initial tucking operation. The other conventional bottom closure panels are folded inwardly around their score lines in the usual manner, after which the tacker and tucker jaws 63 and 64, respectively, as shown in FIG. 1, are moved under the folded pair of carton bottom ends to tack the folded carton bottoms in position, as described more fully hereinafter. The numerals 30 in FIG. 2 indicate the bottom ends of a pair of mandrels carrying the pair of cartons 12.

As shown in FIGS. 2, 3 and 5, the tucker blade 26 is adapted to be moved upwardly by a shaft 36. The shaft 36 is clamped to the tucker blade 26 by a clamp plate 37 and a clamp block 39. As shown in FIG. 2, the tucker blade 26 is provided with a recess on the lower end thereof which has an inner edge 32 and a pair of side edges 33 and 34. The numeral 35 designates the lower edge of the tucker blade 26. The shaft 36 has its upper end positioned centrally in the last described recess in the bottom end of the tucker blade 26. The upper end of the shaft 36 is seated in a partial recess formed in the clamp block 39 and a partial bore 38 (FIG. 5) formed in the clamp plate 37. The tucker blade 26 is secured to the clamp plate 37 by a pair of suitable machine screws 45 which extend through a pair of slots 46 formed through the lower end of the tucker plate 26 and into threaded bores 47 formed in the clamp plate 37 (FIG. 5). As shown in FIG. 5, the clamp block 39 is secured to the clamp plate 37, to clamp the upper end of the shaft 36 there between, by a pair of suitable machine screws 48 which extend through suitable bores in the clamp plate 37 and into threaded engagement with a pair of suitable threaded bores 49 (FIG. 2) formed in the clamp block 39. As shown in FIG. 2, a retainer ring 50 is secured around the upper end of the shaft 36 along the bottom edge of the clamp block 39 and clamp plate 37.

As shown in FIG. 2, the shaft 36 is slidably mounted through a suitable bushing 51 which is seated in a bore 52 that is formed through the lower mounting plate 13. As shown in FIG. 3, the shaft 36 is centrally aligned with the breaker blade 26. As shown in FIGS. 3 and 5, a return spring 41 is mounted around the shaft 36 with its upper end in abutment against the lower end of an integral flange on the bushing 51, and its lower end in abutment with a flat washer 42 that is fixed by any suitable means on the shaft 36.

As illustrated in FIG. 2, the tucker blade 26 is guided in its upward and downward movements by a pair of vertically disposed tucker blade guide posts 55 and 71. As shown in FIG. 2, the one side end 53 of the tucker blade 26 is slidably mounted in a vertical guide slot 54 formed in the guidepost 55 (FIG. 1). The lower end of the guide post 55 is seated on the upper face of the upper horizontal mounting plate 13, and it is fixedly secured thereto by suitable machine screws 56. A vertically disposed shield plate 57 (FIG. 1) is seated in a spaced apart position at the outer side of the guide post 55, and it is provided with an integral horizontal flange 58 which is secured to the bottom face of the mounting plate 13 by the mounting screws 56. The other side 59 of the tucker plate 26 is slidably mounted in a guide slot 60 in the guide post 71. The guide post 71 is secured to the mounting plate 13 by similar machine screws 56.

As shown in FIG. 1, the tacker jaw 63 is rectangularly shaped in plan view, and it extends across the lower ends of the two cartons 11 or 12 which are being tucked and tacked by the tucker-tacker assembly 10. As shown in FIG. 1, the tacker jaw 63 is fixedly secured, as by welding, to a pair of hinges 65 and 66 that are mounted at the outer rear corners thereof. Each of the hinges 65 and 66 is provided with a longitudinally extended bore in which is seated one end of a dowel pin 67 and 68, respectively. The rear ends of the hinges 65 and 66 are slotted, as illustrated in FIG. 9. A pair of clamp screws 69 and 70, as shown in FIG. 1, are mounted through the slotted rear end portions of the hinges 65 and 66, respectively, for clamping the dowel pins 67 and 68 in these hinges.

As shown in FIG. 1, the outer end of the dowel pin 67 is swingably mounted in a suitable bushing 73 which is mounted in the upper end of a support bracket or post 74. The hinge 65 is separated from the upper end of the post 74 by a suitable thrust washer 62. The other dowel pin 68 for the hinge 66 has its outer end swingably mounted in a bushing 76 which is operatively mounted in the upper end of a support bracket or post 75. The hinge 66 is separated from the post 75 by a suitable thrust washer 61. As illustrated in FIG. 3, the lower end 77 of the support bracket or post 74 is enlarged, and it is seated on the upper face of the upper mounting plate 13, and it is secured thereto by suitable machine screws 78. As illustrated in FIG. 5, the other support post 75 also has an enlarged lower end which is seated on the upper face of the mounting plate 13, and it is secured thereto by suitable machine screws 81.

As illustrated in FIG. 1, the tacker jaw 63 is provided with suitable water passages for water cooling the tacker jaw 63. The tacker jaw 63 is provided with a longitudinally disposed water passage 84 which is connected at its ends to the water passages 85 and 86. The water passage 85 extends out through the hinge 66 and terminates in a threaded port 90 which is adapted to receive one end of a suitable water hose fitting 88. The water passage 86 extends rearwardly through the hinge 65 and terminates in a threaded port 89 in which is operatively mounted a suitable water hose fitting 87. It will be understood that the water hose fittings 87 and 88 are connected to a suitable source of cooling water for conducting pressurized cooling water through the passages 85, 84 and 86 for cooling the tacker jaw 63.

The tacker jaw 63 is moved between the inoperative or retracted position shown in FIG. 9 and the operative or advanced position shown in FIG. 3, by the following described structure. As shown in FIGS. 1 and 5, a pair of hinge arms 93 and 94 are laterally spaced apart, and have the inner ends thereof secured to the underside of the tacker jaw 63 by any suitable means, as by welding. As best seen in FIGS. 5 and 9, the outer ends of the hinge arms 93 and 94 are pivotally secured to the upper end of a onventional rod end 97, which is positioned between the hinge arms 93 and 94, by a suitable shoulder screw 95 and a lock nut 96. As best seen in FIG. 9, the lower end of the rod end 97 is provided with a threaded bore in which is threadably mounted the upper end of a threaded rod 98. The rod 98 is secured in an adjusted position in the rod end 97 by a suitable lock nut 99. The lower end of the threaded rod 98 is threadably mounted in a threaded bore 101 which is formed in the upper end of a spring housing 102. The threaded rod 98 is secured in position relative to the spring housing 102 by a suitable lock nut 100. The spring housing 102 is adapted to be mounted through a suitable opening 105 that is formed through the upper horizontal mounting plate 13.

The spring housing 102 has a spring cylinder 106 formed in the lower end thereof. The lower end of the spring cylinder 106 is enclosed by a threadably mounted spring retainer 109. A spring shaft 108 is slidably mounted through a suitable bore 104 formed through the spring retainer 109. The inner end of the spring shaft 108 has an integral flange 107 formed on the inner end thereof. A spring 110 is operatively mounted in the spring cylinder 106 around the shaft 108 with its upper end bearing against the flange 107 and its lower end bearing against the inner end of the spring retainer 109.

As shown in FIG. 9, the lower end of the spring shaft 108 is threaded, as indicated by the numeral 111. The shaft end 111 is threadably mounted in a threaded bore 112 in the head portion 113 of a clevis member. The threaded shaft end 111 is secured in an adjusted position relative to the clevis head 113 by a suitable lock nut 114. As shown in FIG. 5, the last mentioned clevis member includes a pair of integral clevis legs 115 and 116, through the lower ends of which are formed the transverse bores 121 and 122, respectively. A suitable dowel pin 123 is operatively mounted through the bores 121 and 122.

Figure 7:
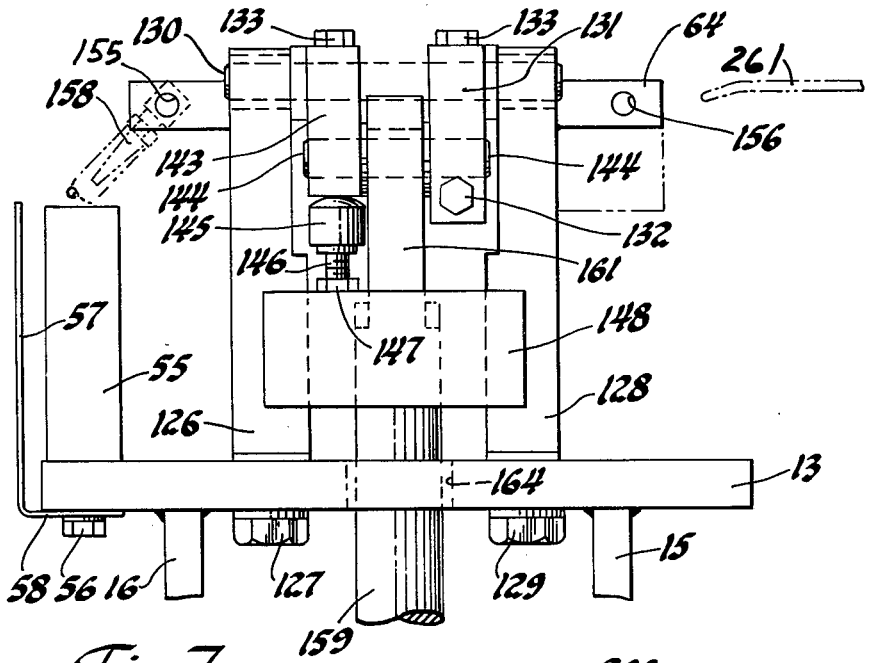
FIG. 7 is a right side elevation view of the tucker-tacker structure illustrated in FIG. 3, taken along the line 7—7 thereof, and looking in the direction of the arrows.

The tucker jaw 64 is also rectangular in plan view as shown in FIG. 1, and it is swingably mounted by the following described structure. As shown in FIGS. 1 and 7, a pair of laterally spaced apart support brackets or posts 126 and 128 are positioned behind the tucker jaw 64, on the upper face of the upper mounting plate 13. The support brackets 126 and 128 are fixedly secured to the mounting plate 13 by suitable machine screws 127 and 129, respectively. A horizontally disposed tucker jaw pivot shaft 130 has its ends operatively mounted, by suitable bearing means, in the upper ends of the support brackets 126 and 128.

As shown in FIG. 1, the tucker jaw 64 is fixedly secured, as by welding, to the inner ends of a pair of laterally spaced apart hinge members 131 and 143. As illustrated in FIG. 9, the hinge member 131 has a bore through which is received one end of a pivot shaft 130. The hinge member 131 is slotted up to the pivot shaft 130 and the hinge portions thereof are clamped together by a suitable clamp screw 133. The hinge member 143 is also secured to the pivot shaft 130 in a similar manner. As shown in FIGS. 1 and 9, the outer end of the hinge member 131 is slotted up to an opening in which is received one end of a dowel pin 144. A suitable clamp screw and nut means 132 is provided for clamping the hinge member 131 to the dowel pin 144. As shown in FIG. 1, the other end of the horizontal dowel pin 144 is operatively mounted through a suitable bore in the other tucker jaw hinge member 143. The tucker jaw hinge members 143 and 131 are laterally spaced apart from the support posts 126 and 128 by a pair of suitable thrust washers 139 and 140, respectively. As shown in FIG. 1, the upper end of a tucker jaw operating lever 161 is hingedly mounted, by suitable bearing means, on a dowel pin 144, between the hinge members 143 and 131, and it is spaced therefrom by a pair of suitable thrust washers 141 and 142.

As shown in FIGS. 1, 3 and 7, the hinge member 143 is extended outwardly so as to have its lower end engage a bumper member 145 when the tucker jaw 64 is in the operative or advanced position shown in FIG. 3. The bumper 145 is operatively carried on a mounting screw 146 which has its lower end threadably mounted in a suitable bore in a bumper mounting block 148. The bumper screw 146 is secured in an adjusted position by a suitable lock nut 147. The bumper mounting block 148 is fixedly secured to the outer sides of the support brackets 126 and 128 by any suitable means, as by welding.

As shown in FIG. 1, the tucker jaw 64 is provided with a longitudinally disposed water passage 154 which is connected at its ends with two water passages 155 and 156. The water passage 155 is connected to a suitable water fitting 158, and the water passage 156 is connected with a water fitting 157. It will be understood that the water fittings 157 and 158 are connected to a suitable source of pressurized cooling water.

As shown in FIG. 9, the lower end of the tucker jaw operating lever 161 is tubular in form, and it is indicated by the numeral 159, and it functions as a spring chamber shaft. As shown in FIG. 9, the spring chamber shaft 159 extends downwardly through an opening 164 formed through the upper mounting plate 13. A longitudinally extended spring chamber 162 is formed inwardly from the lower end of the spring chamber shaft 159, and it is enclosed by a threadably mounted spring retainer 166. A spring shaft 163 is slidably mounted through a bore 160 formed through the spring retainer 166. An integral flange 165 is formed on the inner end of the spring shaft 163. A spring 172 is mounted in the spring chamber 162, and its upper end bears against the lower side of the flange 165, and its lower end bears against the inner end of the spring retainer 166.

As shown in FIG. 9, the lower end of the spring shaft 163 is threaded, as indicated by the numeral 167. The spring shaft threaded end 167 is threadably mounted in a threaded bore 168 formed in the upper end of a knuckle member 170. The threaded shaft end 167 is secured in an adjusted position by a suitable lock nut 169.

As shown in FIG. 5, the knuckle member 170 is mounted in a slot 171 formed between the clevis legs 115 and 116. The knuckle member 170 is provided with a suitable transverse bore, through the lower end thereof, through which is received the dowel pin 123.

As shown in FIG. 5, the outer ends of the dowel pin 123 are mounted in suitable bores formed through the legs 176 and 177 of a U-shaped clevis member, generally indicated by the numeral 175. The clevis member 175 includes the transverse clevis head 179 which connects the clevis legs 176 and 177, and it is provided with a vertical bore 174 (FIG. 9) in which is mounted the upper end of a tacker shaft 180. A flange 173 is formed integrally on the upper end of the tacker shaft 180, and the lower end of the clevis head 179 rests on the flange 173. The tacker shaft 180 is fixedly secured to the clevis head 179 by any suitable means, as by welding. As shown in FIGS. 3 and 5, the clevis leg 176 is split at the upper end thereof, and the split portions are clamped onto the one end of the dowel pin 123 by a suitable clamp screw 178.

As shown in FIG. 3, the tacker shaft 180 is supported in a tacker shaft housing 183 by a pair of spaced apart bushings 180 and 182. The housing 183 extends through a suitable bore 186 in the lower mounting plate 14. The tacker shaft housing 183 has a flange 184 secured thereto, as by welding. The housing flange 184 is secured to the lower side of the lower mounting plate 14 by suitable machine screws 185 (FIGS. 4 and 6).

Figure 3A:
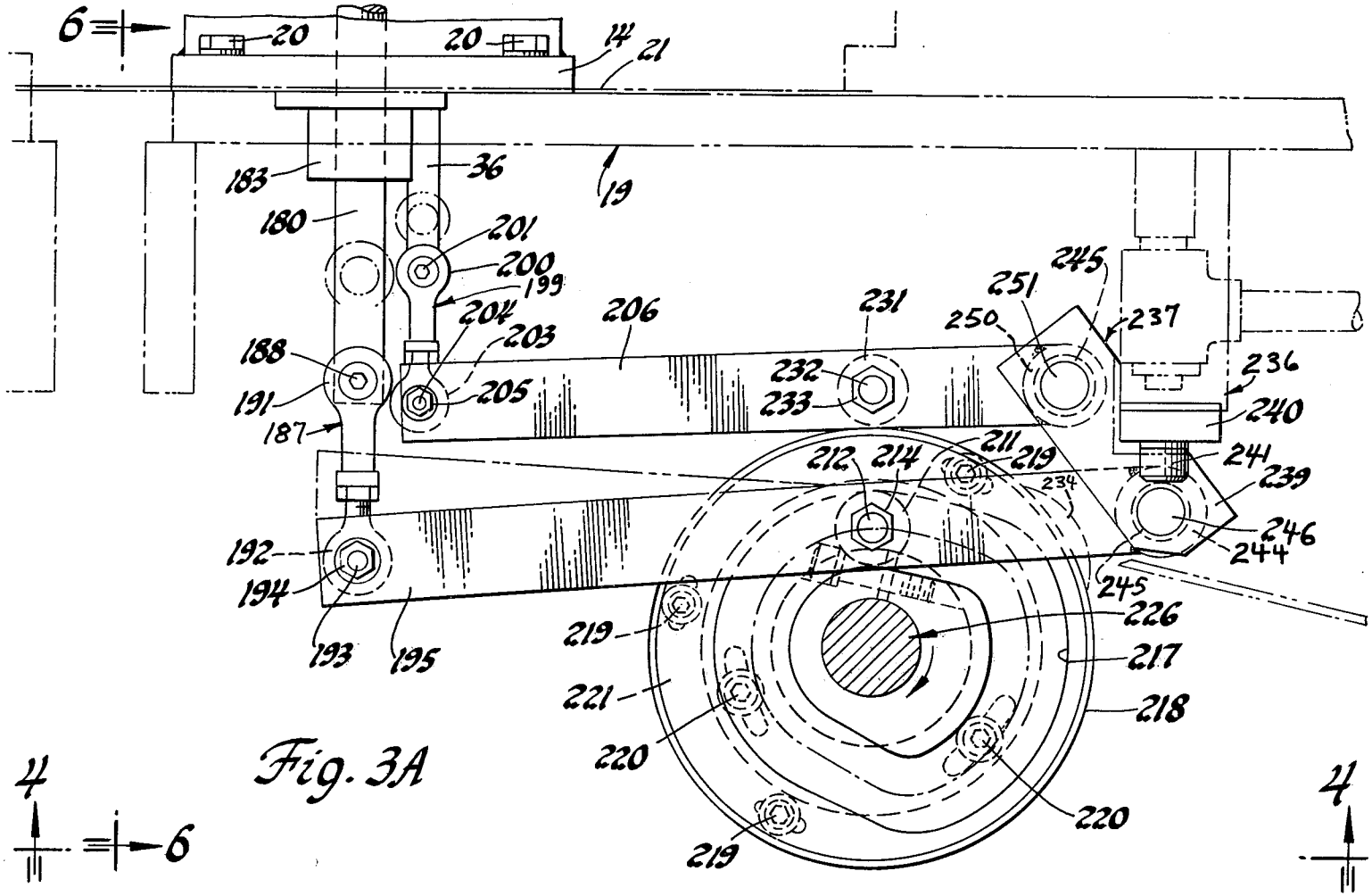
Figure 6:
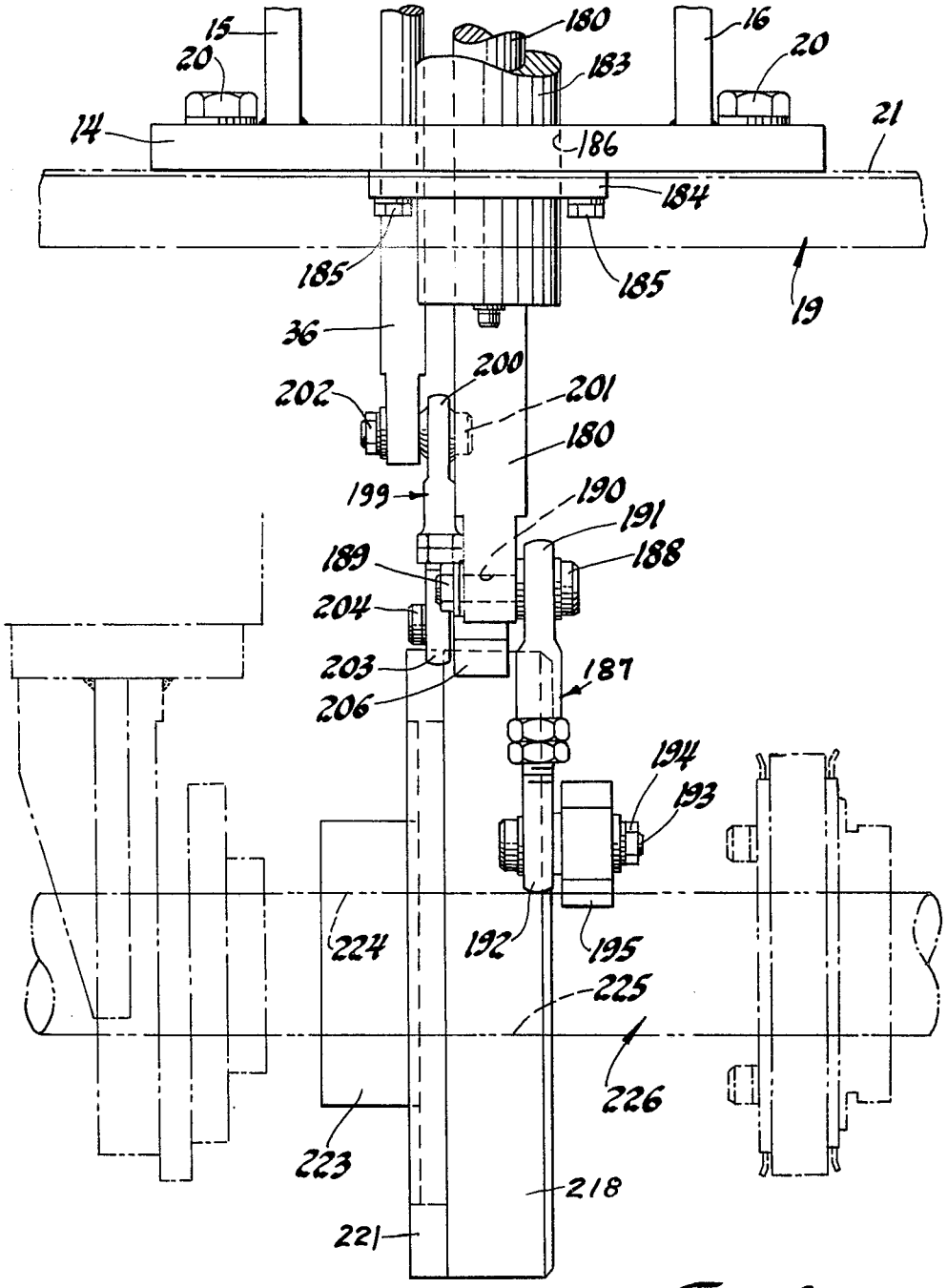
FIG. 6 is a left side elevation view of the tucker-tacker structure illustrated in FIG. 3A, taken along the line 6—6 thereof, and looking in the direction of the arrows.

As shown in FIGS. 3A and 6, the lower end of the tacker shaft 180 is hingedly connected to a suitable connecting rod, which is generally indicated by the numeral 187. The upper end 191 of the connecting rod 187 is hingedly connected to the tacker rod 180 by a suitable socket head screw 188 which passes through a bore 190 (FIG. 6) formed in the lower end of the shaft 180, and which is secured in position by a suitable lock nut 180. The lower end 192 of the connecting rod 187 is hingedly connected to a socket head screw 193 to one end of a tacker lever arm 195. The socket head screw 193 is secured in position by a suitable lock nut 194.

As shown in FIGS. 3A and 6, the lower end of the tucker shaft 36 is hingedly connected to the upper rod end 200 of a connecting rod 199 by a socket head screw 201 which is secured by a lock nut 202. The rod lower end 203 is connected by a socket head screw 204 to one end of a tucker lever arm 206. The socket head screw 204 is secured in position by a lock nut 205.

Figure 8:
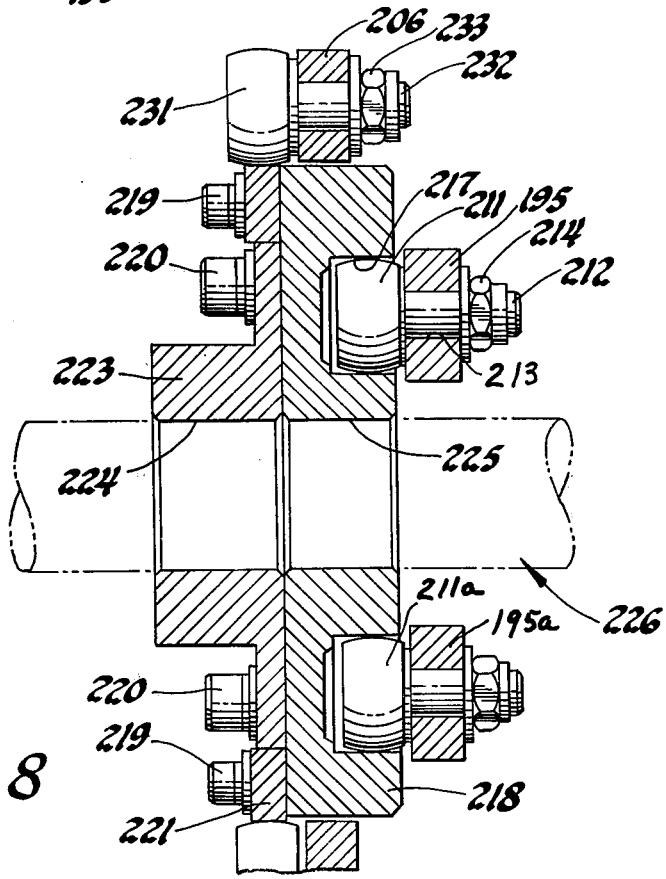
FIG. 8 is a fragmentary, sectional view of the tucker-tacker structure illustrated in FIG. 4, taken along the line 8—8 thereof, and looking in the direction of the arrows.

As shown in FIGS. 3A and 8, a cam roller follower 211 is rollably secured to the tacker lever arm 195 at an intermediate position thereon. The cam roller follower 211 is rollably secured to the tacker lever arm 195 by a suitable socket head screw 212 which extends through a bore 213 (FIG. 8) formed through the tacker lever arm 195. The socket head screw 212 is secured in position by a suitable lock nut 214. The numerals **211*a* and 195*a* show the cam roller follower 211 in the advanced position so as to move the tacker and tucker jaws 63 and 64, respectively, to the advanced or operative positions shown in FIG. 3. FIG. 3A shows the cam roller follower 211 in a position wherein the tacker and tucker jaws 63 and 64, respectively, are in the retracted or inoperative positions shown in FIG. 9**.

As shown in FIGS. 3A and 8, the cam roller follower 211 is rollably mounted in a suitable tacker cam track 217 which is formed in one of the side faces of a rotary tacker cam 218. A ring-shaped tucker cam 221 is secured to the other side face of the tacker cam 218 by a plurality of machine screws 219. A timing hub 223 is also secured to the tacker cam 218 within the ring-shaped tucker cam 221, by a plurality of machine screws 220. As shown in FIG. 8, the timing hub 223 is provided with a bore 224, and the tacker cam 218 is provided with an axial bore 225. The main drive shaft of the packaging machine with which the tucker-tacker assembly is associated, and which is indicated generally by the numeral 226, is operatively received in the bores 224 and 225. The tacker cam 218 and the timing hub 223 are operatively connected to the main drive shaft 226, by any suitable means, for operation of the tucker-tacker assembly 10 in a suitable timed relationship with the other operating carton processing apparatus of the packaging machine.

As shown in FIGS. 3A and 8, a roller cam follower 231 is rollably connected to an intermediate portion of the tacker lever arm 206 by a suitable socket head screw 232 and a lock nut 233. It will be seen that the roller cam follower 231 rolls on the outer periphery of the ring-shaped tucker cam 221, and that it is moved upwardly to pivot the tucker lever arm 206 upwardly when the cam roller follower 231 engages a raised cam portion or lobe 234 on the outer periphery of the tucker cam 221.

As shown in FIGS. 3A and 4, the rear end of the tucker lever arm 206 and the rear end of the tacker lever arm 195 are each hingedly supported by a pivot bracket structure, generally indicated by the numeral 237, which in turn is secured by any suitable means, as by welding, to the supporting structure 236 of the packaging machine. As shown in FIG. 4, the pivot bracket structure 237 includes a pair of laterally spaced apart shaft mounting plates 238 and 239 which are fixedly secured, as by welding, to a horizontal bracket plate which has a first end 240 secured by a suitable machine screw to the packaging machine support structure 236 and a second end 242 which is secured by a suitable machine screw 243 to the packaging machine support structure 236. As shown in FIGS. 3A and 4, the rear end of the tacker lever arm 195 is secured, as by welding, to the outer face of a horizontally disposed tubular pivot hub 244 which is hingedly mounted by a pair of bushings 245 on a pivot shaft 246. As shown in FIG. 4, the ends of the pivot shaft 246 are operatively supported in suitable bores in the shaft mounting plates 238 and 239. The ends of the tubular pivot hub 244 are spaced apart from the shaft mounting plates 238 and 239 by a pair of suitable thrust washers 247.

As shown in FIG. 3A, the rear end of the tacker lever arm 206 is fixedly secured, as by welding, to a tubular pivot hub 250 which is rotatably mounted by a similar pair of bushings 245 on a pivot shaft 251 which has its ends operatively supported by the shaft mounting plates 238 and 239. The tubular pivot hub 250 is spaced from the mounting plates 238 and 239 by a pair of suitable thrust washers 260.

In operation, the rotary turret of the packaging machine would move a pair of the cartons, as 11, into side-by-side positions as shown in FIG. 1, for closing and tacking operation on the bottom end closure members of the two cartons by the tucker-tacker assembly 10 of the present invention. The cartons 11 and 12 may be of the gable or flat top type as shown in U.S. Pat. Nos. 3,120,333; 3,185,375; 3,185,376; 3,270,940; 3,294,310; and, 3,406,892. It will be understood that the operator's controls for the tucker-tacker assembly 10 of the present invention would be incorporated into the overall operator's control means for the packaging machine with which the tucker-tacker assembly 10 of the present invention is associated, and a suitable control circuit means may be employed for timing and controlling the operations of the tucker-tacker assembly 10, since the control circuit means does not form any part of the present invention.

When the rotary turret of the packaging machine has moved a pair of cartons 10 into the positions shown in FIG. 1, the packaging machines main drive shaft 226 is timed to rotate the tacker cam 218 and the tucker cam 221 in the clockwise direction, as viewed in FIG. 3A, so that the tucker cam lobe 234 will engage the tucker cam roller follower 231 and raise the tucker lever arm 206 upwardly to raise the connecting rod 199 to the raised broken line position shown in FIG. 3A. The upward movement of the connecting rod 199 is effected by the tucker lever arm 206 pivoting around the pivot shaft 251, whereby the tucker shaft 36 is moved upwardly. The upward movement of the tucker shaft 36 moves the tucker blade 26 upwardly to the broken line position shown in FIG. 2, so as to perform a bottom end closure breaking and partial folding operation on the triangular panels 269 and 270 of the carton bottom end closure members. Continuing rotation of the tucker cam 221 moves the cam roller follower 231 off of the cam lobe 234 and permits the return spring 41 to bias the tucker shaft 36 and the tucker blade 26 downwardly to the inoperative position. The construction of the tacker cam 218 and the cam track 217, and the position of the cam roller follower 211 on the tacker lever arm 195 is such that just before the tucker blade 26 is in its retracted position, the tacker and tucker jaws 63 and 64, respectively, are rotated upwardly from their inoperative positions shown in FIG. 9 to their operative positions as shown in FIG. 3. The rotation of the packaging machine main shaft 226 rotates the tacker cam 218 so as to actuate the tacker lever arm 195 upwardly to move the connecting rod 187 to the upper broken line position shown in FIG. 3A to operate the tacker and tucker jaws 63 and 64, respectively. It will be understood from the aforedescribed construction of the mounting structure for the tacker jaw 63 and the tucker jaw 64, that they are spring loaded. The tucker jaw 64 is pivoted so as to move the bottom closure tuck-in panel 267 (FIG. 3) into its proper position with the tacker jaw 63 following close behind to move the bottom closure tuck-over panel 268 into its proper position and tack it in place. The tucker jaw 64 is prevented from overtravelling by the bumper stop 146 (FIG. 3). The tacker jaw 63 continues moving to the position shown in FIG. 3 to tack the folded and closed bottom end closure members in place and ready for a successive carton sealing operation at the bottom pressure sealing station 9.

The tucker-tacker assembly 10 of the present invention provides a tucked and tacked carton bottom which is square, and which cannot be thrown off balance when it is moved over the carton transfer guide plate 261 (FIG. 1) to the carton bottom pressure sealing station 9.

Figure 10:
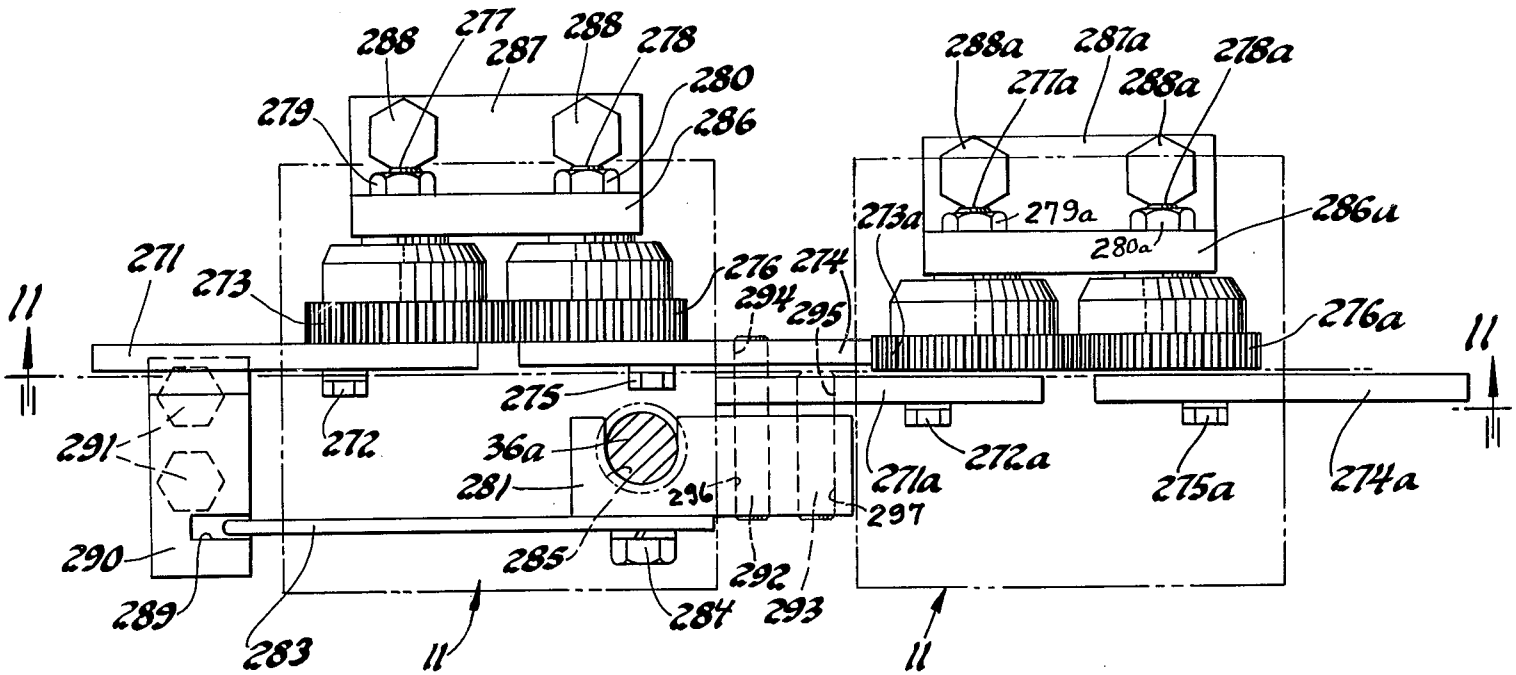
FIG. 10 is a top plan view of a modified tucker structure for use with the tacker structure illustrated in FIGS. 1 through 11.
Figure 11:
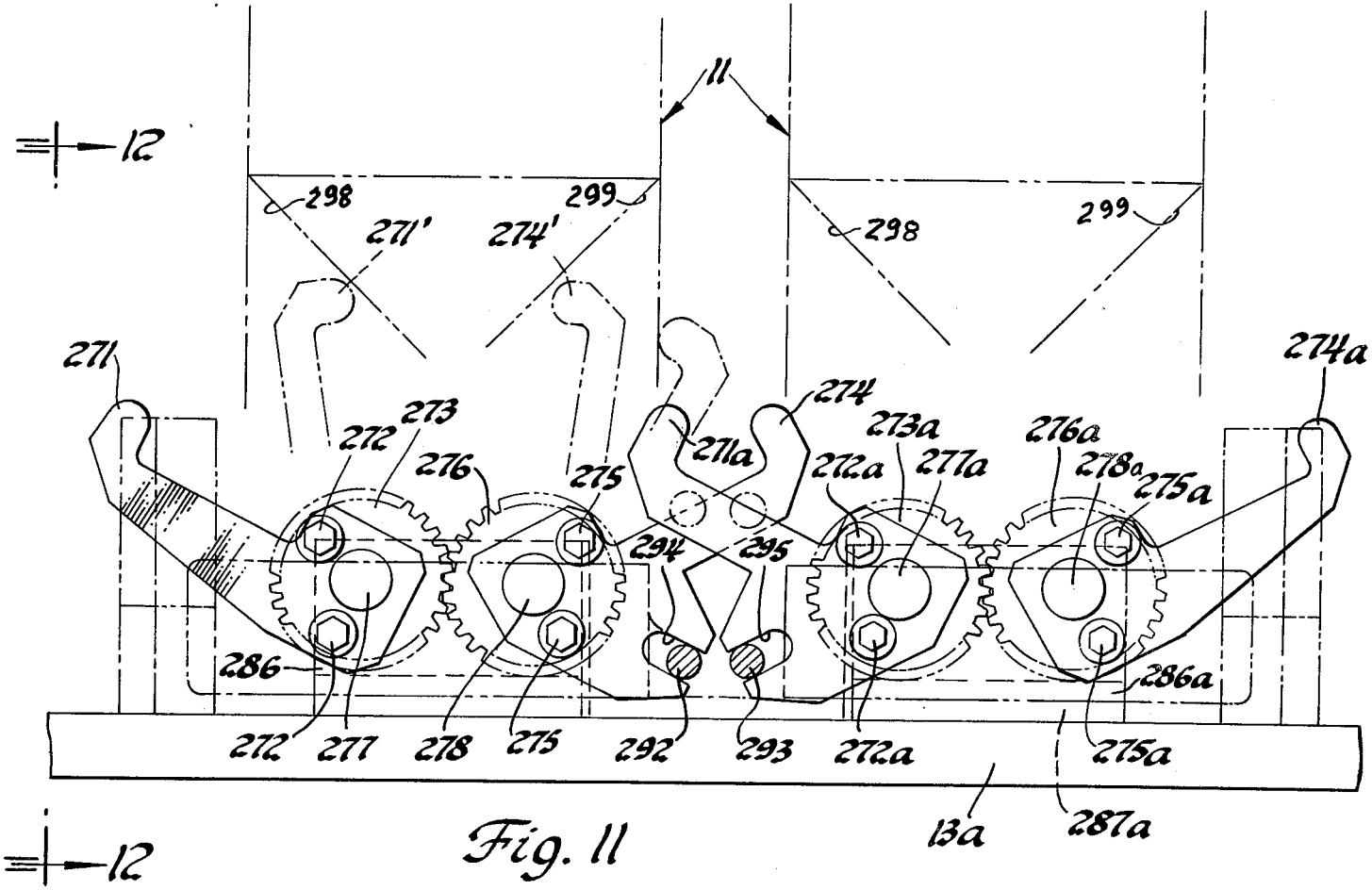
FIG. 11 is a side elevation view of the tucker structure illustrated in FIG. 10, taken along the line 11—11 thereof, and looking in the direction of the arrows.
Figure 12:
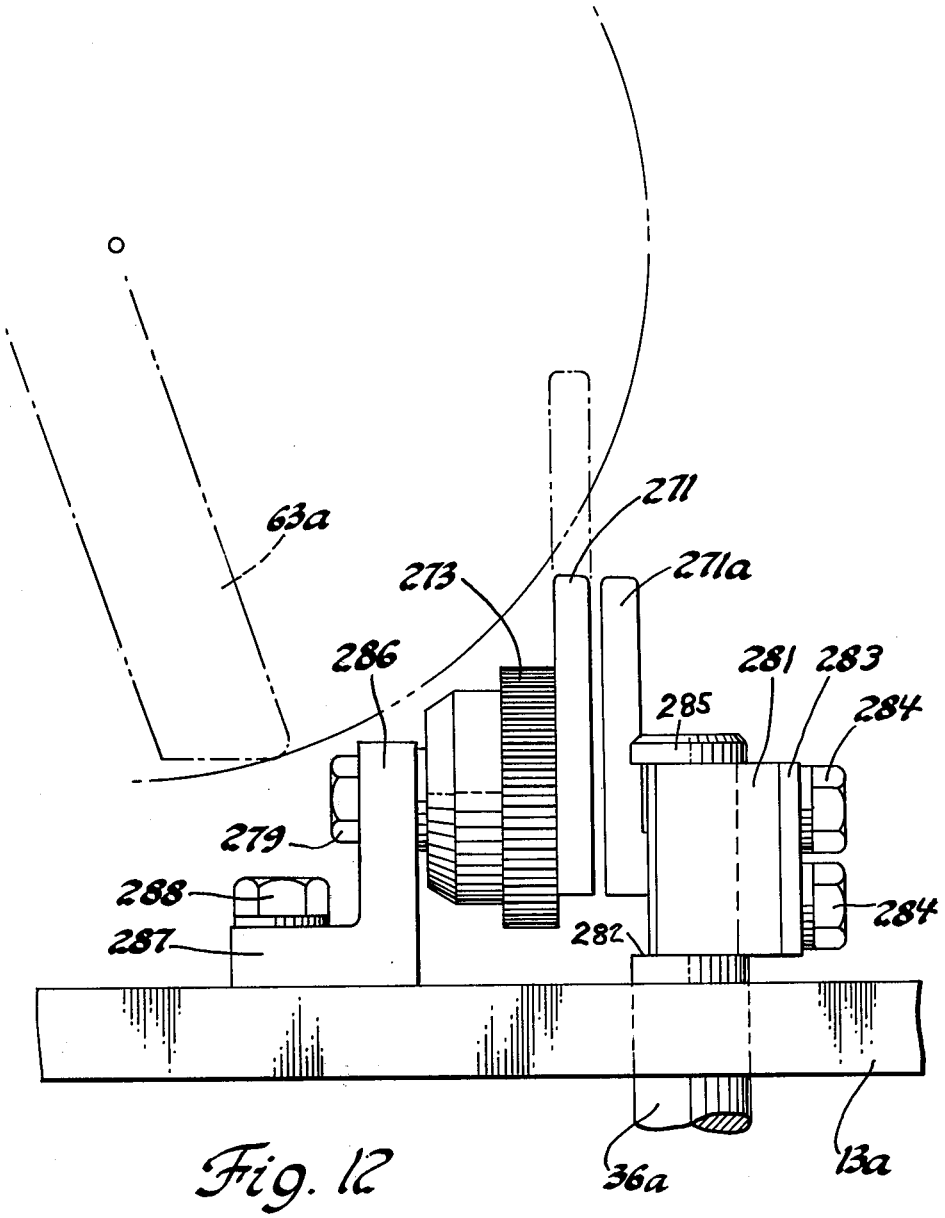
FIG. 12 is a left side elevation view of the tucker structure illustrated in FIG. 11, taken along the line 12—12 thereof and looking in the direction of the arrows.

FIGS. 10, 11 and 12 illustrate a second embodiment of a carton bottom tucker apparatus which may be employed in the tucker-tacker assembly 10 of the present invention. As shown in FIGS. 10 and 11, the carton bottom tucker apparatus second embodiment includes a first pair of tucker blades 271 and 274 and a second pair of identical tucker blades designated by the numerals 271*a* and 274*a*. As shown in FIG. 10, the first pair of tucker blades 271 and 274 are laterally offset slightly from the adjacently positioned tucker blades 271*a* and 274*a*, but the two pairs of tucker blades are positioned parallel to each other and function along the center line of travel of the pair of cartons 10 on which they perform a carton bottom breaking and folding operation. The tucker blades 271 and 274 and their mounting structure are described hereinafter, and the corresponding structure for mounting the second pair of tucker blades 271*a* and 274*a* have been marked with the same reference numerals followed by the small letter "a."

As shown in FIG. 11, the tucker blade 271 is fixedly secured to one face of a rotatable gear 273 by a pair of suitable machine screws 272. The tucker blade 274 is secured by a pair of suitable machine screws 275 to an adjacently disposed gear 276 which is meshed with the gear 273. The gear 273 is rotatably mounted on a horizontally disposed socket head shoulder screw 277 which forms a shaft for the gear 273. The gear 276 is likewise rotatably mounted on a similar socket head shoulder screw 278. As shown in FIG. 10, the socket head screws 277 and 278 are extended through suitable bores in the vertical flange 286 of an angle mounting bracket, and they are secured in place by suitable lock nuts 279 and 280, respectively. As shown in FIG. 12, the angle bracket having the vertical flange 286 also has an integral horizontal flange 287 which is secured to the upper face of an upper mounting plate 13*a* by suitable machine screws 288. The mounting plate 13*a* would be the same as the mounting plate 13 for the first described embodiment of FIGS. 1 through 9. The numeral 63*a* in FIG. 12 illustrates the swinging movement of the tacker jaw 63*a* which would be similar in structure and function as the tacker jaw 63 for the first embodiment of FIGS. 1 through 9.

The four tacker blades 271, 274, 271*a* and 274*a* are adapted to be oscillated between the inoperative and operative positions by the following described structure. As shown in FIGS. 10 and 12, a tucker shaft 36*a*, which would be the same in construction and operation as the tucker shaft 36 for the first embodiment of FIGS. 'through 9, is operatively mounted through a suitable bore in the upper mounting plate 13*a*, and it has mounted on its upper end a dowel pin carrier block 281. The dowel pin carrier block 281 has a vertical U-shaped opening on the inner side thereof which receives a reduced diameter upper end portion of the tucker shaft 36*a* which is formed between an enlarged integral head 285 on the upper end of the shaft 36*a* and a shoulder 282 (FIG. 12). The dowel pin carrier block 281 is secured to the tucker shaft 36*a* by a pair of suitable machine screws 284.

As shown in FIG. 10, a tucker guide plate 283 is fixedly secured by the machine screws 284 to the outer side of the dowel pin carrier block 281. The tucker guide plate 283 is slidably mounted in a vertical slot 289 which is formed in a vertical guide post 290 that is secured by a pair of suitable machine screws 291 to the upper face of the upper mounting plate 13*a*.

As shown in FIG. 10, the dowel pin carried block 281 is provided with a pair of laterally spaced apart bores 296 and 297 which are disposed parallel with the shafts upon which the gears 273 and 276 are mounted. A pair of dowel pins 292 and 293 have their outer ends secured in the bores 296 and 297, respectively, by any suitable means, as by a press fit. The inner ends of the dowel pins 292 and 293 are slidably mounted in a pair of angled cam slots 294 and 295 (FIG. 11) which are formed in the adjacent tucker blades 274 and 271*a*, respectively.

In operation, the tucker apparatus illustrated in FIGS. 10, 11 and 12 would function with the tacker and tucker jaws 63 and 64, respectively, of the first embodiment of FIGS. 1 through 9, and perform the same breaking and folding operation as the tucker blade 26. The tucker shaft 36*a* would be moved upwardly and downwardly by the same structure as described hereinbefore in the first embodiment for operating the tucker shaft 36. As viewed in FIG. 11, it will be seen that when the tucker shaft 36*a* is moved upwardly it will move the dowel pins 292 and 293 upwardly from the solid line positions to the raised broken line positions, to rotate the tucker blades 271 and 274 from their solid line positions to the broken line positions indicated by the numerals 271' and 274' for performing a breaking and tucking operation on the triangular panels 298 and 299 on one of the cartons 11. Simultaneously, the tucker blades 271*a* and 274*a* are also rotated upwardly to perform the same breaking and tucking operation on the corresponding triangular panels 298 and 299 on the other carton 11. When the tucker shaft 36*a* is moved downwardly, the two pairs of tucker blades 271 and 274, and 271*a* and 274*a* are rotated to the solid line positions shown in FIG. 11, and the tacker and tucker jaws 63 and 64, respectively, of the first embodiment of FIGS. 1 through 9 proceed to carry out their cklosing and tacking functions.

The tucker-tacker apparatus 10 of the present invention is especially adapted for use with an indexing packaging machine which indexes a pair of cartons through a carton forming, filling and closing path.

INDUSTRIAL APPLICABILITY

The carton bottom tucking and tacking apparatus of the present invention is adapted for use with packaging machines which package liquid products, granular products, and similar products capable of being loaded into a gable of flat top type carton or container from a flow type filler apparatus, as for example, various dairy products, soft drinks, flowable solid food products, and liquid type products such as oils and the like.

We claim:

1. A carton bottom tucker-tacker assembly for use in a packaging machine for forming, filling and closing cartons, and wherein said packaging machine includes at least two carton mandrels for holding a pair of cartons in side-by-side positions for forming the bottom ends of the pair of cartons after said bottom ends have been heated, characterized in that the tucker-tacker assembly includes:

(a) a tucker apparatus operatively mounted at a carton bottom forming station in the packaging machine beneath said pair of cartons for simultaneous engagement with the bottom closure members of said pair of cartons retained on the pair of carton mandrels for breaking and partially folding the same toward a closed position;

(b) a tucker jaw swingably mounted at said carton bottom forming station beneath said pair of cartons for engaging simultaneously the partially closed bottom closure members of said pair of cartons and moving the tuck-in panel members thereof toward closed positions;

(c) a tacker jaw swingably mounted at said carton bottom forming station beneath said pair of cartons for engaging simultaneously the partially closed bottom closure members of said pair of cartons and moving the tuck-over panel members thereof toward closed positions and tacking the closed bottom closure members in place; and (d) power drive means for operating the tucker apparatus, tucker jaw and tacker jaw.

2. A carton bottom tucker-tacker assembly as defined in claim 1, characterized in that said tucker apparatus includes:

(a) a tucker plate having a pair of recesses formed along the upper edge thereof which each have converging tapered edges for engagement with the bottom end closure members of said pair of cartons for breaking and partially folding the same when the tucker plate is moved from a retracted inoperative position to a raised operative position.

3. A carton bottom tucker-tacker assembly as defined in claim 2, characterized in that said tucker apparatus includes:

(a) guide means for guiding said tucker plate when it is moved between the inoperative and operative positions.

4. A carton bottom tucker-tacker assembly as defined in claim 1, characterized in that said tucker apparatus includes:

(a) two pairs of oscillatable tucker blades movable between retracted, inoperative positions, and rotated, operative positions, whereby when the tucker blades are moved from the inoperative position to the operative position they engage the bottom end closure members of said pairs of cartons for breaking and partially folding the same.

5. A carton bottom tucker-tacker assembly as defined in claim 4, characterized in that said tucker apparatus includes:

(a) guide means for guiding said tucker blades when they are moved between the inoperative and operative positions.

6. A carton bottom tucker-tacker assembly as defined in either one of claims 2 or 4, characterized in that said tacker apparatus power drive operating means includes:

(a) a tucker shaft connected at one end to the tacker apparatus;

(b) a tucker lever arm having one end connected to the other end of the tucker shaft, and the other end pivotally mounted on the packaging machine;

(c) cam means for pivoting said tucker lever arm for moving the tucker shaft upwardly for moving the tucker apparatus from a retracted inoperative position to an operative position; and, (d) spring means for returning the tucker shaft downwardly to the inoperative position.

7. A carton bottom tucker-tacker assembly as defined in claim 6, characterized in that said tacker apparatus includes:

(a) a pair of dowel pins carried on said tucker shaft and slidably engagable with said two pairs of oscillatable tucker blades, for moving the blades between the inoperative and operative positions when the tucker shaft is moved upwardly and downwardly.

8. A carton bottom tucker-tacker assembly as defined in claim 1, wherein said power drive means is characterized in that:

(a) said tucker jaw is hingedly connected to the upper end of a tucker jaw shaft;

(b) said tacker jaw is hingedly connected to the upper end of a tacker jaw shaft;

(c) the lower end of the tucker jaw shaft and the lower end of the tacker jaw shaft are each connected to a tucker-tacker drive shaft by a spring-loaded means; and (d) said tucker-tacker drive shaft is operated by said power drive means.

9. A carton bottom tucker-tacker assembly as defined in claim 8, characterized in that said power drive means further includes:

(a) a tacker lever arm having one end connected to the tucker-tacker drive shaft and the other end pivotally mounted on the packaging machine; and, (b) cam means for pivoting said tacker lever arm for moving the tucker-tacker drive shaft upwardly and downwardly for moving the tucker and tacker jaws between retracted, inoperative positions and operative positions.

10. A carton bottom tucker-tacker assembly as defined in claim 9, characterized in that:

(a) said tucker jaw includes means for limiting the swinging movement of the tucker jaw to prevent overtravel of the tucker jaw in the operative direction.

11. A carton bottom tucker-tacker assembly as defined in claim 9, characterized in that:

(a) said tucker and tacker jaws are water cooled.

* * * * *

UNITED STATES PATENT OFFICE

CERTIFICATE OF CORRECTION

Patent No. 4,221,162 Dated September 9, 1980

Inventor(s) KAUFFMAN et al

It is certified that error appears in the above-identified patent and that said Letters Patent are hereby corrected as shown below:

Column 2, line 10, delete "tucker-tucker" and insert --tucker-tacker--

Column 10, line 55, preceding "through", delete the apostrophe "'" and insert the numeral --1--.

Signed and Sealed this

*Twenty-fifth* Day of *November 1980*

[SEAL]

*Attest:*

SIDNEY A. DIAMOND

*Attesting Officer*

*Commissioner of Patents and Trademarks*